US006116974A

United States Patent [19]

Browning et al.

[11] Patent Number: 6,116,974

[45] Date of Patent: Sep. 12, 2000

[54] SPACERS, DISPLAY DEVICES CONTAINING THE SAME, AND METHODS FOR MAKING AND USING THE SAME

[75] Inventors: Jim Browning, Boise; Surjit S. Chadha, deceased, late of Meridian, both of Id., by Jasbir Chadha, executrix

[73] Assignee: Micron Technology, Inc., Boise, Id.

[21] Appl. No.: 09/145,831

[22] Filed: Sep. 2, 1998

[51] Int. Cl.[7] ..... H01J 9/24

[52] U.S. Cl. ..... 445/24; 445/59

[58] Field of Search ..... 445/24, 25, 41, 445/42, 59

[56] References Cited

U.S. PATENT DOCUMENTS

| | | | |
|---|---|---|---|
| 4,923,421 | 5/1990 | Brodie et al. . | |
| 5,205,770 | 4/1993 | Lowrey et al. . | |
| 5,232,549 | 8/1993 | Cathey et al. . | |
| 5,503,582 | 4/1996 | Cathey, Jr. et al. . | |
| 5,509,840 | 4/1996 | Huang et al. . | |
| 5,564,958 | 10/1996 | Itoh et al. | 445/6 |
| 5,658,832 | 8/1997 | Bernhardt et al. . | |
| 5,684,356 | 11/1997 | Jeng et al. . | |

OTHER PUBLICATIONS

Paul H. Holloway et al., "Production and Control of Vacuum Emission Flat Panel Displays", Dept. of Materials Science & Engineering, Aug. 1995, pp. 47, 48, 50, 53 and 54.

P.R. Schwoebel et al., "Field–Emitter–Array Performance Enhancement Using Glow Discharge Processing", SRI International, Physical Electronics Laboratory, 1991.

E. Giorgi and B. Ferrario, "High Porosity Thick–Film Getters", IEEE Transactions on Devices, vol. 36. No. 11, Nov. 1989, pp. 2744–2747.

P.R. Schwoebel et al., "In Situ Enhancement of Field–Emitter Array Performance:, Revue" Le Vide, les Couches Minces:, Supplement au N 271, Mar.–Apr. 1994, pp. 378.

*Primary Examiner*—Kenneth J. Ramsey
*Attorney, Agent, or Firm*—Trask, Britt & Rossa

[57] ABSTRACT

A display device, and a method for making and operating the display device are described. The display device comprises a base plate containing at least one emitter, a display screen, and a spacer located between the base plate and display screen, where the spacer has a high concentration of an emitter-cleaning material. The spacer may comprise a xerogel or aerogel material and the emitter-cleaning material may comprise hydrogen. The spacer and a method for making the spacer and using the spacer to clean an emitter are also described. The spacer material cleans the emitter by absorbing gases during fabrication of the display device and desorbing emitter-cleaning gases during operation of the display device. By keeping the emitter clean, the spacer retains the work function of the emitter at a low level, thereby prolonging the usefulness of the display device.

66 Claims, 3 Drawing Sheets

SPACERS, DISPLAY DEVICES CONTAINING THE SAME, AND METHODS FOR MAKING AND USING THE SAME

BACKGROUND OF THE INVENTION

This invention relates to display devices, such as field emission displays, plasma displays, and flat panel cathode ray tubes, and methods for making and using the same. Specifically, the invention relates to improved spacers for such display devices and methods for making and using the same.

Display devices visually present information generated by computers and other electronic devices. One category of display devices is electron emitter apparatus, such as a cold cathode field emission display (FED). A FED uses electrons originating from emitter tips on a base plate to illuminate a cathodoluminescent display screen and generate an image. A gate electrode, located near the emitters, and the base plate are in electrical communication with a voltage source. Electrons are emitted when a sufficient voltage differential is established between the emitters and the gate electrode. The electrons strike a phosphor coating on the display screen which emits photons to form the visual image.

In a FED, spacers separate the base plate and the display screen. Numerous processes have been developed for forming spacers for FED devices. U.S. Pat. Nos. 5,509,840, 5,232,549, 5,205,770, and 4,923,421, and Holloway et al., Production and Control of Vacuum in Field Emission Flat Panel Displays, *Solid State Technology*, August 1995, pp. 47–54, all incorporated herein by reference, disclose exemplary processes for forming such spacers.

Numerous materials have been used in the spacers, including ceramic, glass, glass-ceramic, ceramic-reinforced glass, devitrified glass, amorphous glass, metal with electrically insulating coating, bulk resistivity metals such as titanium, aluminum, or chromium oxide, silicon dioxide, silicon nitride, polyamide, or a variation of polyimide, such as Kapton. U.S. Pat. Nos. 5,530,582 and 5,658,832, both incorporated herein by reference, disclose that materials in the form of an aerogel or xerogel may be employed as spacers.

Manufacturers have recognized that a good emitter condition is important to effectively operate display devices. If the emitters become contaminated or oxidized by gases in the display device, the work function of the emitter increases and reduces the current emission, thus degrading the performance of the display device. Several articles discuss the impact of such harmful gases on emitter performance. See Schwoebel et al., Field-Emitter-Array Performance Enhancement Using Glow Discharge Processing, *6th International Vacuum Micro Electronics Conference*, Jul. 12–15, 1993; Itoh et al., Influence of Various Gases on the Emission of Field Emitter Arrays, *Futaba Corporation*, (date unknown); and Schwoebel et al., In Situ Enhancement of Field-Emitter Array Performance, *7th International Vacuum Micro Electronics Conference*, Jul. 4–7, 1994, p. 378; all incorporated herein by reference.

One method of reducing the amount of harmful gases in a display device has been to use gettering materials. See Giorgi et al., High-Porosity Thick-Film Getters, *IEEE Transactions on Electron Devices*, Vol. 36, No. 11, November 1989, pp. 2744–2747. Getters absorb gases, both those generated by components and those leaking in from the atmosphere, thereby minimizing harmful gas in the display device. The getter is often placed in peripheral regions of the display device, such as inactive regions outside the active display area between the base plate and display screen. When the getter is positioned outside the active display area, the size of the respective peripheral area must be increased, reducing the effective display area. Moreover, getters merely absorb gases, and are not used to desorb gases.

U.S. Pat. No. 5,684,356 discloses another method of reducing the damaging effects of harmful gases in a display device. This patent describes a FED device with an insulating layer comprising hydrogen silsesquioxane (HSQ). Under specific operating conditions in the display device, HSQ desorbs hydrogen, thus raising the partial pressure of hydrogen with respect to oxygen and keeping deleterious oxide from forming on the emitters.

SUMMARY OF THE INVENTION

The present invention provides a method of making a display device having at least one emitter by forming at least one spacer having a high concentration of an emitter-cleaning material and disposing the at least one spacer within the display device. The emitter-cleaning material preferably comprises hydrogen. The at least one spacer preferably exhibits a dual-sorption capability, allowing the at least one spacer to chemisorb gases contaminating or oxidizing an emitter and physisorb gases cleaning the emitter.

The present invention also provides a display device comprising a base plate containing at least one emitter, a display screen, and at least one spacer located between the base plate and display screen having a high concentration of an emitter-cleaning material. The at least one spacer preferably comprises a xerogel or aerogel material and the emitter-cleaning material preferably comprises hydrogen. The display device is preferably a field emission display device.

The present invention also provides a method for malting a at least one spacer for a display device containing at least one emitter by forming a sheet comprising a material having a high concentration of an emitter-cleaning material and then removing portions of the sheet to form the at least one spacer. The at least one spacer preferably comprises a xerogel or aerogel material, formed by making a substrate comprising a spacer material, removing a portion of the substrate to form the at least one spacer, and then increasing the concentration of an emitter-cleaning material. Preferably, the emitter-cleaning material comprises hydrogen.

The present invention further provides a at least one spacer for a display device containing at least one emitter, the at least one spacer having a high concentration of an emitter-cleaning material. Preferably, the at least one spacer comprises a xerogel or aerogel material. The emitter-cleaning material preferably comprises hydrogen absorbed from a gas or mixture of gases containing hydrogen. The at least one spacer preferably exhibits the dual-sorption capability mentioned above.

The present invention moreover provides a method of operating a display device containing at least one emitter and at least one spacer having a high concentration of an emitter-cleaning material by causing the at least one spacer to desorb the material to clean the at least one emitter. The present invention also provides a method for cleaning an emitter in a display device by causing at least one spacer having a high concentration of an emitter-cleaning material to desorb the material to clean the at least one emitter.

The present invention provides several advantages over the prior art. The spacer absorbs gases during processing or packaging of the display device and then desorbs helpful gases, such as hydrogen, during operation thereof. The beneficial gases aid in cleaning emitter tips during processing and help keep the tips clean during operation. The beneficial gases, therefore, retain the work function at a low level and keep the emission current high, prolonging the usefulness of the display device.

BRIEF DESCRIPTION OF THE DRAWINGS

Certain aspects of the present invention are illustrated in the accompanying drawings in which.

DETAILED DESCRIPTION OF THE INVENTION

The present invention provides a display device and methods for making and operating the same. In particular, the present invention provides spacers for display devices, such as field emission displays, plasma displays, and other electron-emitting apparatus, and a method for making and using the same. Specifically, the spacers of the present invention are formed of any material, such as an aerogel or xerogel, capable of absorbing gases during fabrication of the display device and releasing beneficial gases, such as hydrogen, during operation of the display device.

The following description provides specific details, such as material thicknesses and types, in order to provide a thorough understanding of the present invention. The skilled artisan, however, will understand that the present invention may be practiced without employing these specific details. Indeed, the present invention can be practiced with conventional fabrication techniques employed in the industry.

The process steps and structures described below neither form a complete process flow for manufacturing display devices nor a completed device. Only the process steps and structures necessary to understand the present invention are described.

The spacers of the present invention may be formed by any process resulting in the properties described below. For example, the spacers may be formed by a process similar to the process described in U.S. Pat. No. 5,658,832. Preferably, however, the spacers of the present invention are formed by the process illustrated in FIGS. 1–4 or FIGS. 5A–5D.

Figure 1:
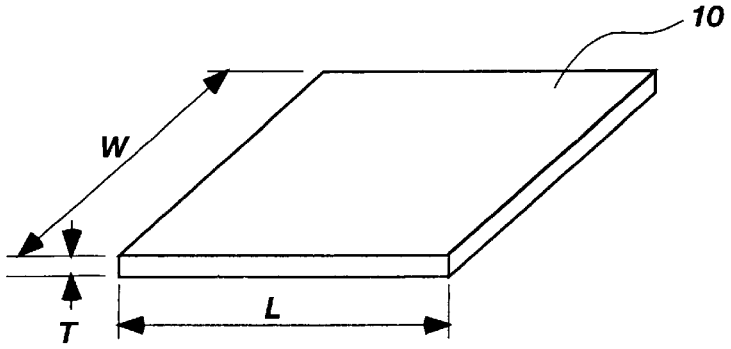
FIGS. 1–4 depict a method of forming spacers according to the present invention.

As shown in FIG. 1, substrate 10 is formed of a sheet of spacer material with thickness T, length L, and width W. A preferred spacer material of the present invention is gel materials, especially aerogel and xerogel materials. Aerogels and xerogels are generally considered as solid materials having a gas dispersed therein. In substrate 10, for example, thickness T may be on the order of 10 $\mu$m to 1000 $\mu$m, while length L and width W will be on the order of inches to feet. Different methods of formulating aerogels and xerogels are known in the art and can be employed to form the spacers of the present invention.

In a preferred method of formulating the aerogel or xerogel spacer, a sol or solution of the gel material is formed. The solution can be one component or a multi-component. If the aerogel or xerogel is a silica-based material, there are many silicon alkoxides, such as tetraethylorthosilicate (TEOS), that undergo a sol-gel transition by hydrolysis and polymerization. The hydrolysis and polymerization reaction is initiated by mixing TEOS and water in a solvent, such as ethanol, at a constant temperature.

The polymerization continues until the mixture becomes an elastic gel. The gel contains a solvent phase which must be removed by drying to leave a low density structure. Whether an aerogel or xerogel is formed depends on how the solvent is removed. For aerogels, the drying is performed at a temperature and pressure above the solvent critical point, thus bypassing the liquid-vapor interface of the solvent. The vapor is then vented, leaving a network of material with about 95% porosity and a pore size on the order of about 10 to 50 nm (100 to 500 Å). During subsequent processing, this network is de-aired and the pores are closed by heat treatment.

Xerogels are similar to aerogels, but are dried by naturally evaporating solvent and water to the atmosphere. While the liquid is evaporating, the gel structure is collapsing on itself. Xerogels are generally denser than aerogels and have smaller pores, i.e., a pore size on the order of 2 to 5 nm (20 to 50 Å), yet are simpler to manufacture than aerogels.

Figure 2:
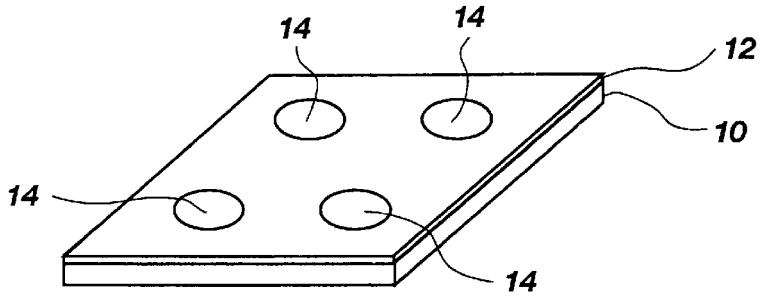

Substrate 10 can be formed with the desired dimension and geometrical configuration using a suitable mold. Following formation of substrate 10, a photopatterning and dry etch process can be used to pattern openings 16 and channels 18 in substrate 10 as depicted in FIGS. 2–4 and described below.

After forming substrate 10, etch mask 12 is formed on substrate 10. Etch mask 12 may be a photoresist layer patterned by passing ultraviolet light, or another form of radiant energy, through a reticle containing the desired pattern. The photoresist is then developed for removing either the exposed portions of resist for a positive resist or the unexposed portion for a negative resist to form a pattern of openings 14.

Figure 3:
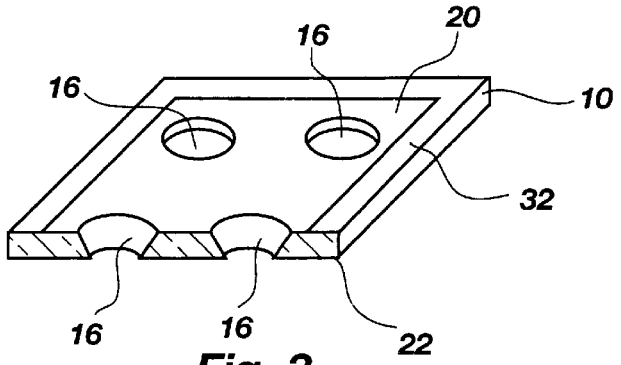
Figure 4:
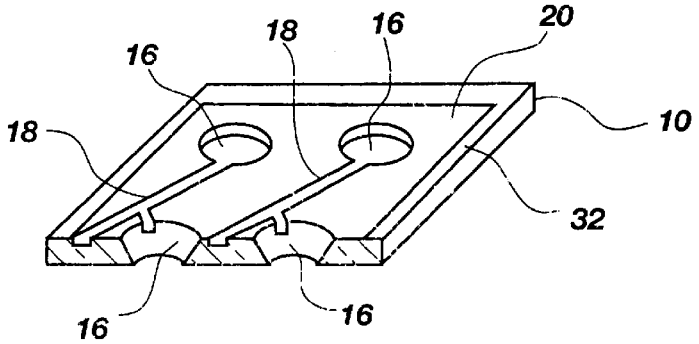

As depicted in FIG. 3, etch mask 12 containing openings 14 is used to etch openings 16 through substrate 10. Substrate 10 may be etched using a dry etch process, such as reactive ion etching (RIE) or plasma etching. Suitable gas etchants for etching aerogels and xerogels include fluorine species such as $CF_4$, $SF_4$, and $SF_6$. Aerogels and xerogels are easily etched and, therefore, high aspect ratio features (i.e., high ratio of length to diameter) can be formed. Following this etch process, etch mask 12 is stripped by using suitable wet chemicals, such as a solution of sulfuric acid or hydrogen peroxide.

Openings 16 in substrate 10 have a generally conical shape with a diameter that decreases from a top surface 20 to a bottom surface 22 of the substrate 10. In the assembled FED 34 shown in FIG. 6, openings 16 allow electrons emitted from emitters 40 of the FED 34 to pass through the substrate 10 to display screen 48. In a plasma display device, the openings 16 would provide a space for generating a plasma Substrate 10 includes borders 32 along the periphery thereof. Borders 32 are relatively thicker than the remainder of substrate 10 and can be formed by an etch process similar to the above-described process for forming openings 16. Borders 32 provide a framework or support structure.

As illustrated in FIG. 4, channels 18 are formed in the top surface 20 of substrate 10. Channels 18 interconnect openings 16 with one another and to borders 32 of substrate 10. Channels 18 provide a conduit for gas removal during evacuation of the assembled FED, as explained below. Channels 18 may be formed by a photopatterning and etch process similar to the process described above for forming openings 16 in substrate 10.

Instead of a dry etch process for forming openings 16 and channels 18 in substrate 10, a laser ablation process may be used. Similar to the dry etch process, the laser ablation process uses an etch mask carrying the desired pattern on substrate 10. A laser is then directed at substrate 10 to ablate excess substrate material and form openings 16 and channels 18. The laser can also be preprogrammed to scribe excess material, thus eliminating the patterning step.

Figure 5A:
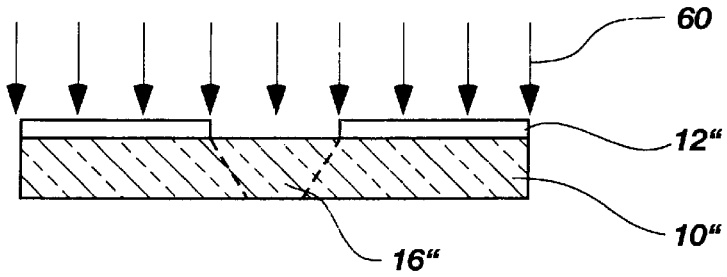
FIGS. 5A–5D depict another method of forming spacers according to the present invention.

FIGS. 5A–5D illustrate another process for forming the spacers of the present invention. As shown in FIG. 5A, mask 12' is placed on substrate 10', which is formed in the same manner as substrate 10, but containing a photosensitive material. Exposure to a source of radiation, such as collimated light 60, forms latent image 16' similar to opening 16 described above.

Figure 5B:
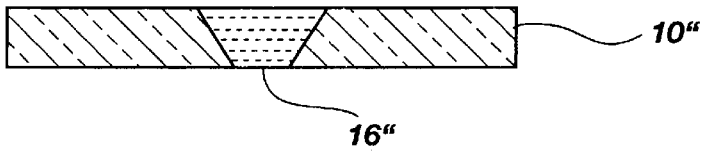
Figure 5C:
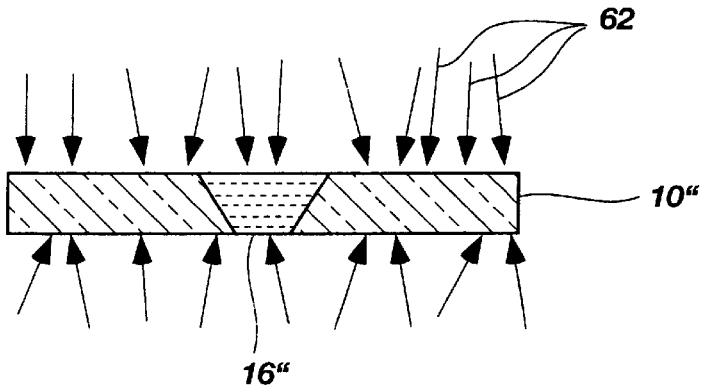

As depicted in FIG. 5B, mask 12' is removed and latent image 16' is developed by heating to a temperature ranging from about 500° to about 600° C. Next, as shown in FIG. 5C, substrate 10' is flooded with uncollimated UV light 62. No mask is required for this process, which exposes the clear areas of substrate 10'.

Figure 5D:
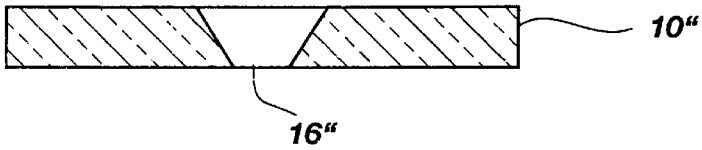

As illustrated in FIG. 5D, substrate 10' is etched to form opening 16'. Depending on the substrate material, this etching may use a wet etchant, such as dilute HF acid. Following the etching, substrate 10' can be further processed as required. For example, if photosensitive glass material is used as substrate 10, it can be heated to a temperature of about 850° C. to convert the glass material to a ceramic.

Channels similar to channels 18 can then be formed in the same manner as openings 16' by controlling the depth of the etch. Furthermore, borders similar to borders 32 can be formed by etching a rectangular area in substrate 10' to a required depth.

The spacers of the present invention exhibit the following properties. The spacers are sufficiently non-conductive to prevent electrical breakdown between the cathode of the display screen and the anode of the display screen, in spite of the close spacing and voltage differential between the electrodes. The spacers also have sufficient mechanical strength so as to exhibit very little creep (slow deformation over time) and withstand atmospheric pressure sufficient to prevent the two electrodes from collapsing. Since electrons are generated at the emitters, the spacers also withstand electron bombardment without deleterious effects. Further, the spacers of the present invention withstand "bakeout" temperatures (required to create the vacuum between the base plate and display screen) of about 400° C. Moreover, the spacers are small enough so as not to visibly interfere with the display operation—if the spacer is not small enough, electrons from the emitters (being closely packed to obtain a high resolution) will be intercepted before striking the phosphor coated display face, thus degrading the brightness of the display. Additionally, the spacers of the present invention maintain the emitters and opposed display screen insulated from one another at a relatively small and uniform distance, thereby assuring the desired thinness and high resolution.

The spacer must also be able to exhibit dual-sorption. As used in the present invention, "dual-sorption" means that the spacer chemisorbs and physisorbs gases. Physisorption is a reversible process in which gases are absorbed on the surface of the substrate but may be released, or desorbed, at a later time. Chemisorption is a permanent process, similar to gettering, in which the gases are chemically absorbed.

To operate efficiently, a vacuum of about $10^{-7}$ torr must be maintained within the FED cavity formed by the display screen and base plate. Over time, the pressure in the cavity increases from outgassing of components and from the atmosphere leaking into the cavity. The gases from the outgassing and atmospheric leakage can help or hinder the emission characteristics of the display device, depending on the gas.

Helpful gases include, but are not limited to, hydrogen, methane ($CH_4$), and carbon monoxide (CO). It is believed, especially in the case of hydrogen, that these gases reduce oxidation and contamination of the emitter tips, as well as maintain the phosphor luminescence. It is believed that these gases treat the emitter surface and condition the surface, improving and stabilizing the emitter performance. Oxidation and contamination of the metal of the emitter changes their work functions, often by as much as 25–50%. Harmful gases include, but are not limited to, sulfur dioxide, oxygen, water vapor, sulfur, and hydrogen sulfide ($H_2S$).

Accordingly, the spacers of the present invention exhibit dual-sorption: they physisorb helpful gases and chemisorb harmful gases during fabrication of the FED. The spacers then desorb the helpful gases during operation of the display device. Preferably, in the case of aerogels and xerogels, the dual-sorption capability is helped by the porosity of the spacer.

Once substrate 10 is formed, the concentration of a material desorbing the helpful gases is increased in the substrate to obtain a high concentration of this material. A "high concentration" in the present invention means that the spacer contains a sufficient concentration of the desired material to desorb in the form of a helpful gas during operation of the FED. The concentration of the material, using hydrogen as the exemplary helpful gas, can be increased by numerous methods, including those described below.

In one method of increasing the concentration, hydrogen or methane is present in the ambient atmosphere during fabrication of the display device, especially the atmosphere present during the bake and seal-in period. If not already present, the gas can be injected into the processing chamber. As the hydrogen concentration increases in the ambient atmosphere, more hydrogen will be absorbed by the spacers. During operation of the display device, because the hydrogen has only been physisorbed, it will be released by the spacers.

As an alternative to the step of increasing the concentration of material desorbing helpful gases once the spacer is formed, a sufficiently high concentration of material desorbing helpful gases may be incorporated directly into the spacer itself during its formation. For example, when hydrogen is the helpful gas to be desorbed, the spacer could comprise a metal hydride. Other gas-releasing materials encompassed by the present invention include HSQ.

In another method of increasing the concentration, a layer of the desired gas-desorbing material can be coated on the spacer. For example, after the spacer is formed, the gas-desorbing material, such as HSQ, could be coated on the spacer. Alternatively, such material could be coated on the spacer material prior to patterning and etching the conventional spacer material.

Figure 6:
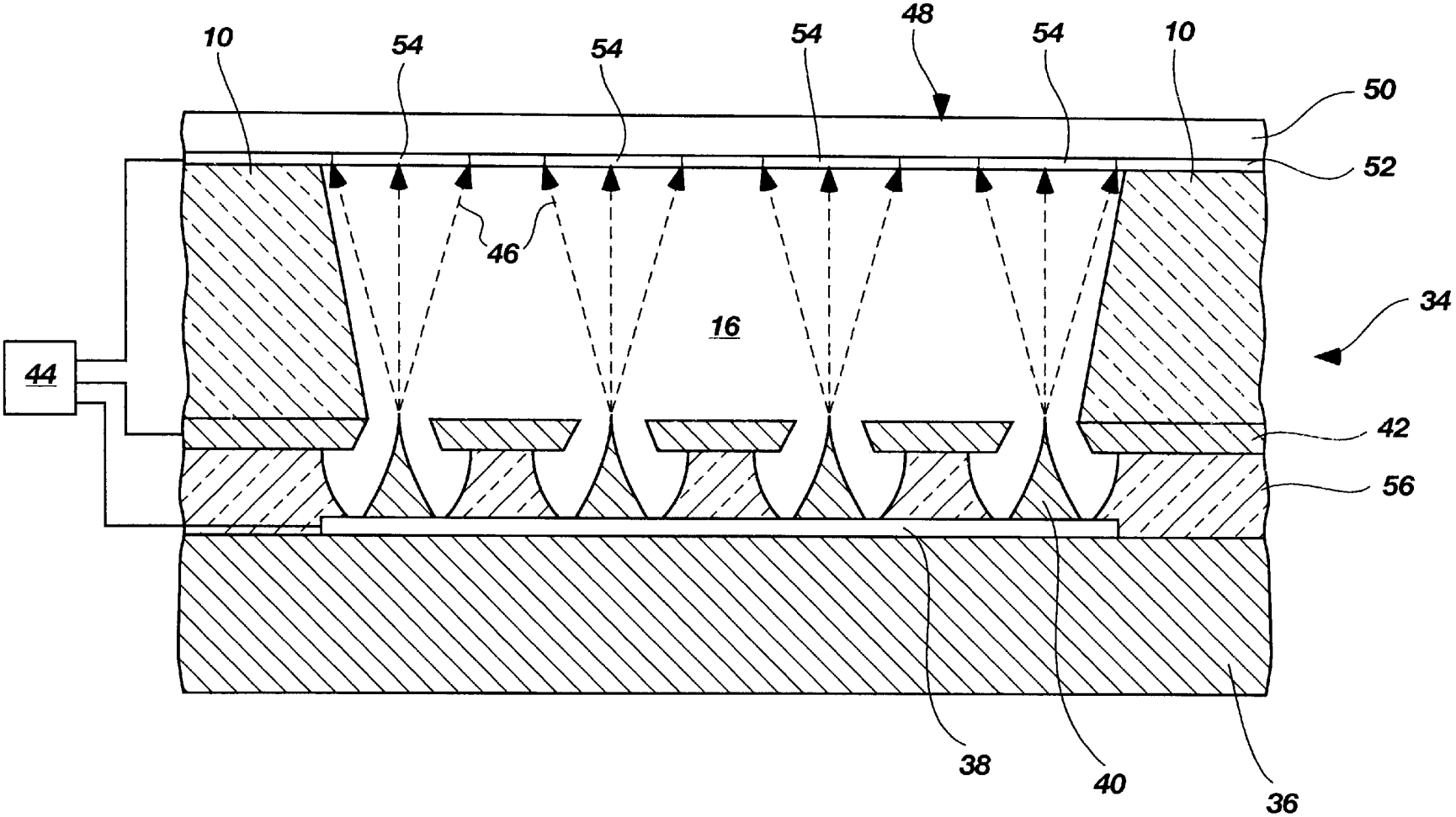
FIG. 6 depicts an assembled FED containing spacers formed according to the invention.

After forming the spacer and increasing the concentration of the gas-desorbing material, the display device is assembled. As depicted in FIG. 6, the preferred FED 34 is assembled with substrate 10 (or 10') functioning as a spacer. The assembled FED 34 includes base plate 36 formed with a conductive layer 38. An array of electron-emitting emitter sites 40 is formed on the conductive layer 38. A gate electrode structure, or grid 42, is associated with the emitter sites 40. The grid 42 and base plate 36 are connected to an electrical source 44 which establishes a voltage differential for initiating an electron emission from emitters 40. Grid 42 is separated from base plate 36 by insulating layer 56. Insulating layer 56 provides support for grid 42 and prevents the breakdown of the voltage differential applied by source 44. Electrons 46 emitted by emitters 40 impinge on a cathodoluminescent display screen 48. Display screen 48 includes external glass face 50, transparent electrode 52, and phosphors 54.

In assembled FED 34, substrate 10 is placed between base plate 36 and display screen 48. Following assembly of FED 34, substrate 10 functions as an interelectrode spacer. During the assembly process, openings 16 in the substrate 10 are precisely aligned with the emitters 40. This allows a free flow of electrons from the emitter sites 40 to the display screen 48.

Following assembly of FED 34, the interior of FED 34 is evacuated to a pressure of $10^{-6}$ Torr or less using an evacuation pump or similar apparatus. During the evacuation process, the FED 34 is typically heated to a temperature of around 400–550° C. to create a high vacuum between base plate 36 and display screen 48 of the FED 34, thereby sealing base plate 36 and display screen 48 together. If necessary, a suitable sealing material can be provided at peripheral portions of base plate 36 and display screen 48 to aid in sealing them together. During the evacuation process, channels 18 formed in substrate 10 provide a conduit for gas removal from openings 16 and from interior of FED 34. Channels 18 terminate at borders 32 of substrate 10 and can thus be placed in direct flow communication with the evacuation pump.

Emitters 40 in FED 34 are energized by applying a positive voltage potential to gate electrode 42 and base plate 38 operating as the cathode, thereby inducing an electric field which draws electrons from the tip of the emitter. The emitted electrons are accelerated toward transparent electrode 52, which is positively biased by applying a larger positive voltage. Energy from the electrons attracted to the anode are transferred to particles of the phosphor coating 54, resulting in luminescence.

While the preferred embodiments of the present invention have been described above, the invention defined by the appended claims is not to be limited by particular details set forth in the above description, as many apparent variations thereof are possible without departing from the spirit or scope thereof. For example, although the method of the invention has been described as forming interelectrode spacers for a FED, the skilled artisan will understand that the process and spacers described above can be used for other display devices, such as plasma displays and flat cathode ray tubes.

It is claimed:

1. A method of making a display device having at least one emitter, comprising:

forming at least one spacer having a high concentration of an emitter-cleaning material;

disposing the at least one spacer within the display device.

2. The method of claim 1, wherein the at least one spacer comprises a xerogel or aerogel material.

3. The method of claim 2, further comprising forming the substrate by a sol-gel process.

4. The method of claim 3, wherein the sol-gel process forms spacers comprising silica.

5. The method of claim 4, wherein the sol-gel process uses a TEOS solution to form the spacers comprising silica.

6. The method of claim 1, wherein the emitter-cleaning material is hydrogen, carbon monoxide, or methane.

7. The method of claim 6, wherein the emitter-cleaning material is hydrogen.

8. The method of claim 1, wherein the display device is a field emission display or plasma display.

9. The method of claim 8, wherein the display device is a field emission display.

10. The method of claim 1, wherein the at least one spacer exhibits a dual-sorption capability, thus chemisorbing gases contaminating or oxidizing an emitter and physisorbing gases cleaning the emitter.

11. The method of claim 1, wherein disposing the at least one spacer within the display device includes locating the at least one spacer between opposing faces of the display device and reducing the pressure between the opposing faces.

12. The method of claim 11, wherein the opposing faces of the display device are a base plate and a display screen.

13. The method of claim 12, wherein the base plate contains at least one emitter thereon.

14. The method of claim 12, further comprising reducing the pressure by creating a vacuum and sealing the base plate and display screen together.

15. A display device, comprising:

a base plate containing at least one emitter;

a display screen;

at least one spacer located between the base plate and display screen, the at least one spacer having a high concentration of an emitter-leaning material.

16. The device of claim 15, wherein the at least one spacer comprises a xerogel or aerogel material.

17. The device of claim 15, further comprising obtaining the high concentration from absorbed gaseous species of the emitter-cleaning material.

18. The device of claim 15, further comprising obtaining the high concentration from the material used to construct the at least one spacer.

19. The device of claim 15, further comprising obtaining the high concentration from a coating on the at least one spacer.

20. The device of claim 15, wherein the emitter-cleaning material is hydrogen, carbon monoxide, or methane.

21. The device of claim 20, wherein the emitter-cleaning material is hydrogen.

22. The device of claim 15, wherein the display device is a field emission display or plasma display.

23. The device of claim 22, wherein the display device is a field emission display.

24. The device of claim 15, wherein the at least one spacer exhibits a dual-sorption capability.

25. A method for making at least one spacer for a display device containing at least one emitter, comprising:

forming a sheet comprising a material having a high concentration of an emitter-cleaning material; and removing portions of the sheet to form the at least one spacer.

26. The method of claim 25, wherein the at least one spacer comprises a xerogel or aerogel material.

27. The method of claim 26, further comprising forming the sheet by a sol-gel process.

28. The method of claim 27, wherein the sol-gel process forms spacers comprising silica.

29. The method of claim 28, wherein the sol-gel process uses a TEOS solution to form the spacers comprising silica.

30. The method of claim 25, further comprising increasing the concentration of the emitter-cleaning material by providing a processing atmosphere containing the emitter-cleaning material in a gas or a mixture of gases.

31. The method of claim 25, wherein forming a sheet of a material having a high concentration of said emitter-cleaning material comprises forming at least a portion of said sheet from said emitter-cleaning material.

32. The method of claim 25, further comprising increasing the concentration of the emitter-cleaning material by coating the emitter-cleaning material on the at least one spacer.

33. The method of claim 25, wherein the emitter-cleaning material is hydrogen, carbon monoxide, or methane.

34. The method of claim 33, wherein the emitter-cleaning material is hydrogen.

35. The method of claim 25, further comprising removing the portion of the sheet by using a laser ablation process or a dry etch process.

36. The method of claim 25, wherein the sheet material exhibits a dual-sorption capability.

37. A spacer for a display device containing at least one emitter, the spacer having a high concentration of an emitter-cleaning material.

38. The spacer of claim 37, wherein the spacer comprises a xerogel or aerogel material.

39. The spacer of claim 37, further comprising obtaining the high concentration from absorbed gaseous species of the material.

40. The spacer of claim 37, further comprising obtaining the high concentration from the material used to construct the spacer.

41. The spacer of claim 37, further comprising obtaining the high concentration from a coating on the spacer.

42. The spacer of claim 37, wherein the emitter-cleaning material is hydrogen, carbon monoxide, or methane.

43. The spacer of claim 42, wherein the emitter-cleaning material is hydrogen.

44. The spacer of claim 37, wherein the display device is a field emission display device.

45. The spacer of claim 37, further exhibiting a dual-sorption capability.

46. A method of operating a display device containing at least one emitter and at least one spacer having a high concentration of an emitter-cleaning material, comprising causing the at least one spacer to desorb said material to clean said at least one emitter.

47. The method of claim 46, wherein the at least one spacer comprises a xerogel or aerogel material.

48. The method of claim 46, wherein the emitter-cleaning material is hydrogen, carbon monoxide, or methane.

49. The method of claim 48, wherein the emitter-cleaning material is hydrogen.

50. The method of claim 46, wherein the display device is a field emission display or plasma display.

51. The method of claim 50, wherein the display device is a field emission display.

52. The method of claim 46, wherein the at least one spacer exhibits a dual-sorption capability.

53. A method for cleaning an emitter in a display device, comprising causing at least one spacer having a high concentration of an emitter-cleaning material to desorb said material to clean said emitter.

54. The method of claim 53, wherein the at least one spacer comprises a xerogel or aerogel material.

55. The method of claim 53, wherein the emitter-cleaning material is hydrogen, carbon monoxide, or methane.

56. The method of claim 55, wherein the emitter-cleaning material is hydrogen.

57. The method of claim 53, wherein the display device is a field emission display or plasma display.

58. The method of claim 57, wherein the display device is a field emission display.

59. The method of claim 53, wherein the at least one spacer exhibits a dual-sorption capability.

60. The method of claim 1, wherein forming the at least one spacer includes; forming a substrate comprising the spacer material; and removing a portion of the substrate to form at least one opening through said spacer.

61. The method of claim 60, further comprising removing the portion of the substrate by using a laser ablation process or a dry etch process.

62. The method of claim 60, further comprising:

increasing the concentration of said emitter-cleaning material in said at least one spacer.

63. The method of claim 1, further comprising:

increasing the concentration of said emitter-cleaning material in said at least one spacer.

64. The method of claim 63, wherein increasing the concentration of the emitter-cleaning material in said at least one spacer comprises providing a processing atmosphere containing the emitter-cleaning material in a gas or a mixture of gases.

65. The method of claim 63, further comprising:

forming the increased concentration of the emitter-cleaning material by coating the emitter-cleaning material on the at least one spacer.

66. The method of claim 1, wherein forming the at least one spacer comprises:

incorporating the emitter-cleaning material directly in said at least one spacer.

* * * * *

UNITED STATES PATENT AND TRADEMARK OFFICE

CERTIFICATE OF CORRECTION

PATENT NO. : 6,116,974
DATED : September 12, 2000
INVENTOR(S) : Browning et al.

It is certified that error appears in the above-identified patent and that said Letters Patent is hereby corrected as shown below:

Title page,
ABSTRACT, line 1, after "device" delete ","

Drawings,
Figs. 5A, 5B, 5C and 5D, change "10″", "12″" and "16″" to -- 10′ --, -- 12′ -- and -- 16′ -- (all occurrences).

Column 1,
Line 5, insert -- Government Rights: This invention was made with United States Government support under Contract No. DABT63-93-C-0025 awarded by the Advanced Research Projects Agency (ARPA). The United States Government has certain rights in this invention. --
Line 54, after "*Corporation*" delete ",";

Column 2,
Line 36, change "malting" to -- making --;
Line 37, delete "a" at beginning of the line;
Line 48, delete "a";

Column 4,
Line 54, after "plasma" insert -- . --;

Column 5,
Line 27, change "10," to -- 10', --;

Column 7,
Line 35, change "base plate" to -- conductive layer --; and
Line 50, change "a FED," to -- an FED, --.

Column 7, claim 1,
Line 58, after "material;" insert -- and --;

Column 8, claim 11,
Line 16, after "reducing" delete "the";

Column 8, claim 14,
Line 24, after "and" insert -- the --;

Column 8, claim 15,
Line 27, after "screen;" insert -- and --;
Line 28, after "and" insert -- the --;
Line 30, change "emitter-leaning" to -- emitter-cleaning --;

UNITED STATES PATENT AND TRADEMARK OFFICE

CERTIFICATE OF CORRECTION

PATENT NO. : 6,116,974
DATED : September 12, 2000
INVENTOR(S) : Browning et al.

It is certified that error appears in the above-identified patent and that said Letters Patent is hereby corrected as shown below:

Column 8, claim 18,
Line 37, after "from" delete "the";

Column 9, claim 30,
Line 3, change "a sheet" to -- said sheet --;
Line 4, change "a material" to -- said material --; and change "a high" to -- said high --;

Column 9, claim 35,
Line 16, change "portion" to -- portions --;

Column 9, claim 39,
Line 27, before "material" insert -- emitter-cleaning --;

Column 9, claim 40,
Line 29, after "from" delete "the";

Column 9, claim 46,
Line 44, after "said" insert -- emitter-cleaning --;

Column 10, claim 53,
Line 9, after "said" insert -- emitter-cleaning --;

Column 10, claim 60,
Line 24, after "comprising" delete "the"; and after "includes" delete ";"; and
Line 27, after "said" insert -- at least one --.

Signed and Sealed this

Ninth Day of April, 2002

*Attest:*

*Attesting Officer*

JAMES E. ROGAN
*Director of the United States Patent and Trademark Office*